US011791089B2

(12) United States Patent
Schneggenburger et al.

(10) Patent No.: US 11,791,089 B2
(45) Date of Patent: Oct. 17, 2023

(54) COIL COMPONENT

(71) Applicant: Schmidhauser AG, Romanshorn (CH)

(72) Inventors: Christof Schneggenburger, Guettingen (CH); Dirk Schekulin, Gais (CH); Bernhard Laeng, Romanshorn (CH); Silvia Gross-Kaeufler, Romanshorn (CH); Tobias Diefenbacher, St. Josefen (CH)

(73) Assignee: Schmidhauser AG, Romanshorn (CH)

( * ) Notice: Subject to any disclaimer, the term of this patent is extended or adjusted under 35 U.S.C. 154(b) by 897 days.

(21) Appl. No.: 16/606,510

(22) PCT Filed: Apr. 20, 2018

(86) PCT No.: PCT/EP2018/060204
§ 371 (c)(1),
(2) Date: Oct. 18, 2019

(87) PCT Pub. No.: WO2018/193098
PCT Pub. Date: Oct. 25, 2018

(65) Prior Publication Data

US 2021/0118609 A1 Apr. 22, 2021

(30) Foreign Application Priority Data

Apr. 21, 2017 (DE) ..... 10 2017 206 778.0

(51) Int. Cl.
*H01F 27/00* (2006.01)
*H01F 27/29* (2006.01)
(Continued)

(52) U.S. Cl.
CPC ..... *H01F 27/29* (2013.01); *H01F 27/02* (2013.01); *H01F 27/24* (2013.01); *H01F 27/327* (2013.01);
(Continued)

(58) Field of Classification Search
CPC ..... H01F 27/022; H01F 27/025; H01F 27/22; H01F 27/24; H01F 27/28; H01F 27/29;
(Continued)

(56) References Cited

U.S. PATENT DOCUMENTS 4,576,768 A 3/1986 Markert et al.
7,765,687 B2 * 8/2010 Pitzele ..... H05K 7/1417 361/740
(Continued)

FOREIGN PATENT DOCUMENTS

CN 102376416 A 3/2012
CN 102486963 A 6/2012
(Continued)

OTHER PUBLICATIONS

Chinese-language Office Action issued in Chinese Application No. 201880026336.1 dated Nov. 2, 2020 (seven (7) pages).
(Continued)

*Primary Examiner* — Paul D Kim
(74) *Attorney, Agent, or Firm* — Crowell & Moring LLP

(57) ABSTRACT

A coil component includes a cup, a magnetic core, an electric conductor wound around the core, a cover, which closes the cup, and electric terminal contacts, which are in electric contact with ends of the electric conductor. The core and the electric conductor are arranged in the cup and the cup is filled with potting compound.

11 Claims, 3 Drawing Sheets

(51) Int. Cl.

| | |
|---|---|
| ***H01F 27/02*** | (2006.01) |
| ***H01F 27/24*** | (2006.01) |
| ***H01F 27/32*** | (2006.01) |
| ***H01F 41/02*** | (2006.01) |
| ***H01F 41/06*** | (2016.01) |
| ***H01F 41/12*** | (2006.01) |
| *H01F 27/28* | (2006.01) |

(52) U.S. Cl.
CPC ..... *H01F 41/0206* (2013.01); *H01F 41/06* (2013.01); *H01F 41/127* (2013.01); *H01F 27/28* (2013.01)

(58) Field of Classification Search
CPC .... H01F 27/327; H01F 17/062; H01F 41/005; H01F 41/0206; H01F 41/06; H01F 41/127
See application file for complete search history.

(56) References Cited

U.S. PATENT DOCUMENTS

| | | | | |
|---|---|---|---|---|
| 8,471,668 | B2 | 6/2013 | Hsieh et al. | |
| 8,653,924 | B2 | 2/2014 | Kobayashi et al. | |
| 9,841,441 | B2 * | 12/2017 | Claeys | H01F 38/30 |
| 10,256,026 | B2 | 4/2019 | Frey et al. | |
| 2001/0008044 | A1 | 7/2001 | Machado | |
| 2011/0215891 | A1 * | 9/2011 | Sundstrom | H01F 41/00 29/606 |
| 2012/0139684 | A1 | 6/2012 | Kobayashi et al. | |
| 2013/0215580 | A1 | 8/2013 | Lin et al. | |
| 2017/0092416 | A1 * | 3/2017 | Rylko | H01F 27/22 |

FOREIGN PATENT DOCUMENTS

| | | | |
|---|---|---|---|
| CN | 105765676 | A | 7/2016 |
| DE | 20 2005 015 853 | U1 | 2/2007 |
| DE | 10 2008 017 303 | A1 | 10/2009 |
| EP | 0 129 819 | A1 | 1/1985 |

OTHER PUBLICATIONS

International Search Report (PCT/ISA/210) issued in PCT Application No. PCT/EP2018/060204 dated Aug. 2, 2018 with English translation (four (4) pages).
German-language Written Opinion (PCT/ISA/237) issued in PCT Application No. PCT/EP2018/060204 dated Aug. 2, 2018 (six (6) pages).

* cited by examiner

COIL COMPONENT

BACKGROUND AND SUMMARY OF THE INVENTION

The invention relates to a coil component, a coil component combination, and a method for manufacturing a coil component.

The invention is based on the object of providing a coil component, a coil component combination and a method for manufacturing a coil component which permit the best possible dissipation of heat from the coil component with a small design of the coil component.

The invention achieves the object by means of a coil component, a coil component combination and a method for manufacturing a coil component in accordance with the claimed invention.

In the simplest case, the coil component according to the invention forms a single electric coil (can also be designated as a choke) with a defined inductance. To this extent, reference should also be made to the relevant specialist literature. The coil component according to the invention can also form multiple electric coils, for example three electric coils, which, for example, are wound over a common soft magnetic core and are therefore magnetically coupled.

The coil component according to the invention comprises a cup.

The coil component according to the invention further comprises a in particular soft magnetic core. The core can be a ferromagnetic core.

The coil component according to the invention further comprises at least one electric conductor wound around the core and having a number of windings, for example between one and 100 windings. The coil component according to the invention can have further electric conductors wound around the (same) core, which, for example, are wound around different circular segments of the core. Here, each conductor can form an electric coil.

The coil component according to the invention further has a cover, which closes the cup, for example covers an opening of the cup.

The coil component according to the invention further comprises electric terminal contacts, which are in electric contact with ends of the electric conductor or the electric conductors. The terminal contacts are used to connect the coil component to a coil periphery, for example to connect the coil component to associated electric contacts of a device or circuit board. The terminal contacts can be formed, for example, as a screw connection.

The core and the electric conductor/s is/are arranged within the cup.

The cup is partly or completely filled with potting compound, in particular in such a way that the core and the electric conductor/s are completely surrounded by the potting compound.

In one embodiment, the core is an annular core.

In one embodiment, the coil component has one or more electrically insulating film/s, which partly or completely cover/s an inner surface of the cup or the cup interior. The electrically insulating film can, for example, cover a cup base.

In one embodiment, the potting compound contains polyurethane, thermally conductive filler and a hardener and/or aluminum oxide powder.

In one embodiment, the cup consists of plastic or of metal, in particular aluminum.

In one embodiment, the cup is circularly cylindrical or has a circularly cylindrical cavity, into which the electric conductor and the core are inserted.

In one embodiment, the cup has a flat or level base plate and a sleeve, for example, circularly cylindrical sleeve, wherein the base plate and the sleeve, joined together as intended, form the cup.

In one embodiment, the coil component has a (cooling) pin, wherein the pin is pushed through an opening in the core, wherein the core, the electric conductor and the pin are arranged in the cup and are potted by means of the potting compound. The pin consists, for example, of metal. The electrically insulating film can be wound around the pin, in order to insulate the pin electrically from the electric conductor or the winding.

In one embodiment, the pin has fixing means, which are designed to fix the coil component mechanically to a circuit board and/or to a heat sink.

In one embodiment, the coil component has further electric conductors, which are wound around the common core. For example, the coil component can have three electric conductors overall, which each form a winding. The coil component has a corresponding number of further electric terminal contacts, which are in electric contact with associated ends of the further electric conductors. For example, the coil component can form three coils, so that there is a total of six electric terminal contacts (two per coil).

In one embodiment, the cover is formed as a circuit board, wherein conductor tracks which connect the electric terminal contacts electrically to the ends of the electric conductor/s are formed on the circuit board.

The invention further relates to a coil component combination which has a plurality of coil components, for example three coil components, and a single cup main body, wherein the cups of the respective coil components are formed in the cup main body or are formed by means of the cup main body.

In one embodiment, the cup main body is formed in such a way that it forms a heat sink.

The invention further relates to a method for manufacturing a coil component and/or a coil component combination. The method comprises the steps: winding at least one electric conductor around a in particular soft magnetic core, inserting the electric conductor wound around the core and the core—and, if appropriate, a pin and electrically insulating film—into a cup, filling the cup with potting compound, closing the cup with a cover, and providing ends of the electric conductor with electric terminal contacts.

In one embodiment, the filling of the cup with potting compound comprises the following steps: heating the electric conductor, the core and the cup—and, if appropriate, the pin and the electrically insulating film—to a first temperature during, for example, 45 minutes, potting the cup with potting compound, heating the electric conductor, the core, the cup and the potting compound—and, if appropriate, the pin and the electrically insulating film—to a second temperature, maintaining the second temperature during a first time period, heating the electric conductor, the core, the cup and the potting compound—and, if appropriate, the pin and the electrically insulating film—to a third temperature, and maintaining the third temperature during a second time period. The first temperature can, for example, lie in a temperature range between 78° C. and 82° C., the second temperature can, for example, likewise lie in a temperature range between 78° C. and 82° C., and the third temperature can, for example, lie in a temperature range between 108° C.

and 112° C. The first time period can be, for example, 90 minutes, and the second time period can likewise be, for example, 90 minutes.

In one embodiment, the filling of the cup with potting compound comprises the following steps: filling the cup with aluminum oxide powder, shaking the cup and/or tamping the aluminum oxide powder, and sealing a surface of the aluminum oxide powder with a sealing medium.

In one embodiment, a respective position of the electric terminal contacts is chosen depending on an installation situation of the coil.

According to the invention, a conventional choke or multiple conventional chokes, each formed by the core and the electric conductor or conductors wound around the core, are inserted into the cup, for example consisting of base plate and plastic cylinder. The pin for improved heat dissipation can be inserted in the center of the cup. The electrically insulating film can be arranged under and around the choke/s. The positioning of the electric contacts can be configured variably.

As an alternative to a plastic cup, a deep-drawn aluminum cup can also be used, which permits dissipation of heat via the outer sleeve and the inner pin. As a result of this encapsulation, increased mechanical strength and improved heat dissipation are provided.

During the manufacture, following heating of the components to optimally 80° C. in the cup under vacuum, for example a mixture of polyurethane with thermally conductive filler with a hardener is potted into the cup. By means of subsequent further tempering to 80° C. for 90 minutes and then 110° C. for 90 minutes, the curing is carried out. The advantage of this method is that the choke core does not break. Otherwise, temperature swings during the operation could lead to cracks, caused by the different expansion coefficients of the various materials of the overall structure.

As a result of the thermally conductive potting compound, the dissipation of heat is increased as compared with the conventional annular core choke. On this basis, the overall size of the choke can be reduced and thus a substantially higher power density can be provided.

In addition, the electric contacts are fixed at the defined location. The positioned contacts make it possible to connect the chokes directly to a power circuit board by means of screw connection. As a result of the screw connection, soldering flexible cables on and therefore the risk of mixing up the stranded wires to be contacted is avoided. As a result, the space required and the contact resistance can be minimized and better EMC values can be achieved.

An alternative to the use of polyurethane as potting compound is the use of aluminum oxide powder. In this variant, the aluminum oxide powder is tipped into the container with continuous shaking. The surface must then be sealed, for example with a hard potting compound, in order that the powder remains compressed.

The following advantages are achieved by means of the invention: a smaller design, a high power density associated therewith, connection by screwing to a power circuit board, improved heat dissipation, improved EMC properties, economical manufacture and polarity reversal protection.

BRIEF DESCRIPTION OF THE DRAWINGS

The invention will be described in more detail below with reference to the drawings, in which.

DETAILED DESCRIPTION OF THE DRAWINGS

Figure 1:
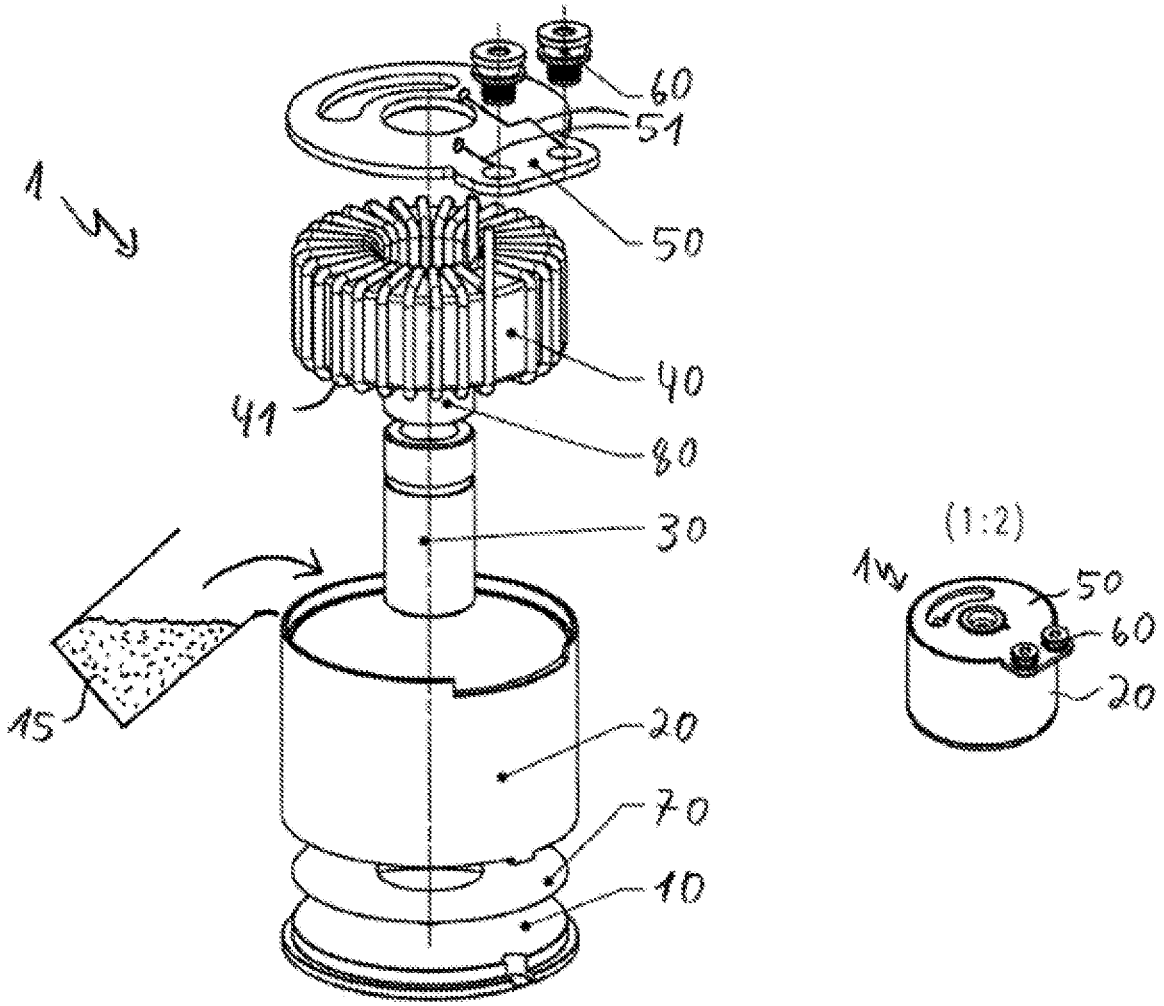
FIG. 1 shows an exploded illustration of a coil component according to the invention according to a first embodiment.

FIG. 1 shows an exploded illustration of a coil component 1 according to a first embodiment.

The coil component 1 has a circularly cylindrical plastic cup, which is formed from a plastic base plate 10 and a plastic sleeve 20.

The coil component 1 has a ferromagnetic annular core 40, wherein an electric conductor 41 of the coil component is wound around the core 40.

The coil component 1 has two electric terminal contacts 60, which are connected electrically to ends of the electric conductor 41 via conductor tracks 51 of a circuit board 50. The ends of the electric conductor 41 are soldered to the circuit board 50 at suitable passage openings. In the state in which the coil component 1 is ready to operate, the circuit board 50 closes the cup 10, 20, i.e. the circuit board 50 simultaneously forms a cover for the cup 10, 20.

The coil component 1 further comprises a copper pin 30, which is pushed through an opening in the annular core 40.

The coil component 1 further comprises electrically insulating films 70, 80. The circularly cylindrical film 70 covers the base plate 10 of the cup, and rectangular film 80 is wound around the pin 30.

In the state in which the coil component 1 is ready to operate, the core 40, the electric conductor 41, the pin 30 and the films 70, 80 are arranged in the cup 10, 20, wherein the cup 10, 20 is filled with potting compound 15. The potting compound 15 contains polyurethane, thermally conductive filler and a hardener. Alternatively, the potting compound can contain aluminum oxide powder.

The pin 30 has fixing means, which are designed to fix the coil components 1 to a circuit board.

The coil component 1 can be used as a choke and has a defined inductance between its electric terminal contacts 60.

The coil component 1 can be manufactured as follows.

The electric conductor 41 is wound around the core 40, as illustrated in FIG. 1. The electrically insulating films 70, 80 are arranged suitably and the copper pin 30 is pushed through the opening in the core 40 and then screwed to the base plate 10. The base plate 10 and the sleeve 20 are then connected to each other, for example by the base plate 10 and the copper pin 30 fixed thereto and the core 40 and the winding 41 surrounding the core 40 being pushed into the sleeve 20 from below as a combination. The base plate 10 and the sleeve 20 can be connected to each other, for example, by means of a latching connection.

Tempering of the coil component 1 is then carried out. After the components have been heated to optimally 80° C., a mixture of polyurethane with thermally conductive filler with a hardener is potted into the cup 10, 20 filled as described above under vacuum. Curing is carried out by means of subsequent further tempering to 80° C. for 90 minutes and then 110° C. for 90 minutes.

Subsequently, the cup 10, 20 can be enclosed with the cover or the circuit board 50 and the ends of the electric conductor 41 can be brought into electric contact with the electric terminal contacts 60, by the ends of the electric conductor 41 being soldered to corresponding soldering points of the cover or the circuit board 50. These steps can also be carried out before the tempering.

Figure 2:
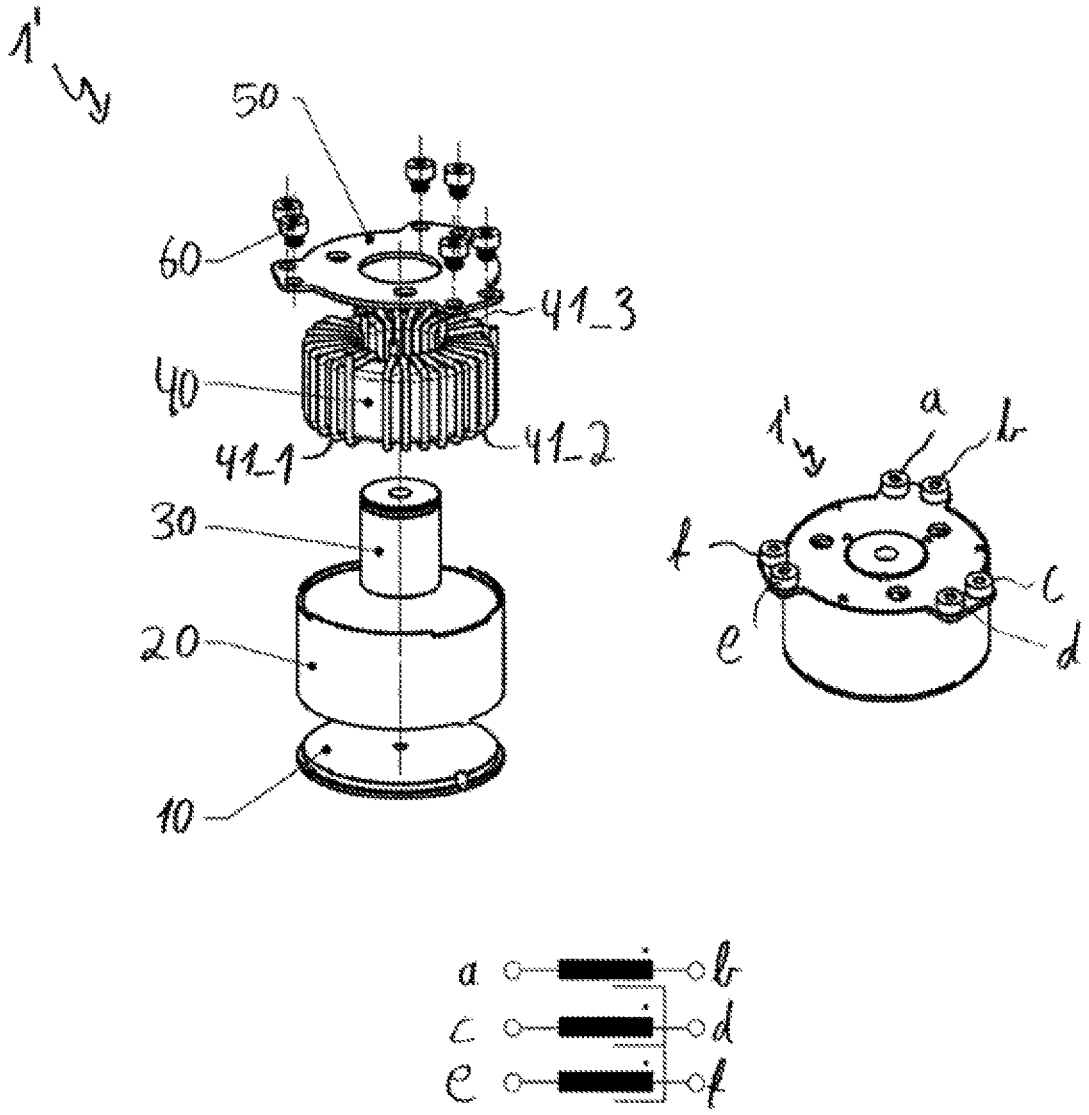
FIG. 2 shows an exploded illustration of a coil component according to the invention according to a further embodiment.

FIG. 2 shows an exploded illustration of a coil component 1' according to a further embodiment.

In this embodiment of the coil component 1', in addition to the electric conductor 41, here designated as 41_1, two further electric conductors 41_2 and 41_3, which are likewise wound around the core 40, are provided. Accordingly, further electric terminal contacts 60 are provided, which are in electric contact with associated ends of the further electric conductors 41_2, 41_3 by means of the circuit board or the cover 50.

The electrically insulating films 70, 80 from FIG. 1 are not shown in the embodiment from FIG. 2 but can also be present in this embodiment.

An electric equivalent circuit diagram of the coil component is illustrated at the bottom.

Otherwise, reference should be made to the explanations relating to FIG. 1, in order to avoid repetitions.

Figure 3:
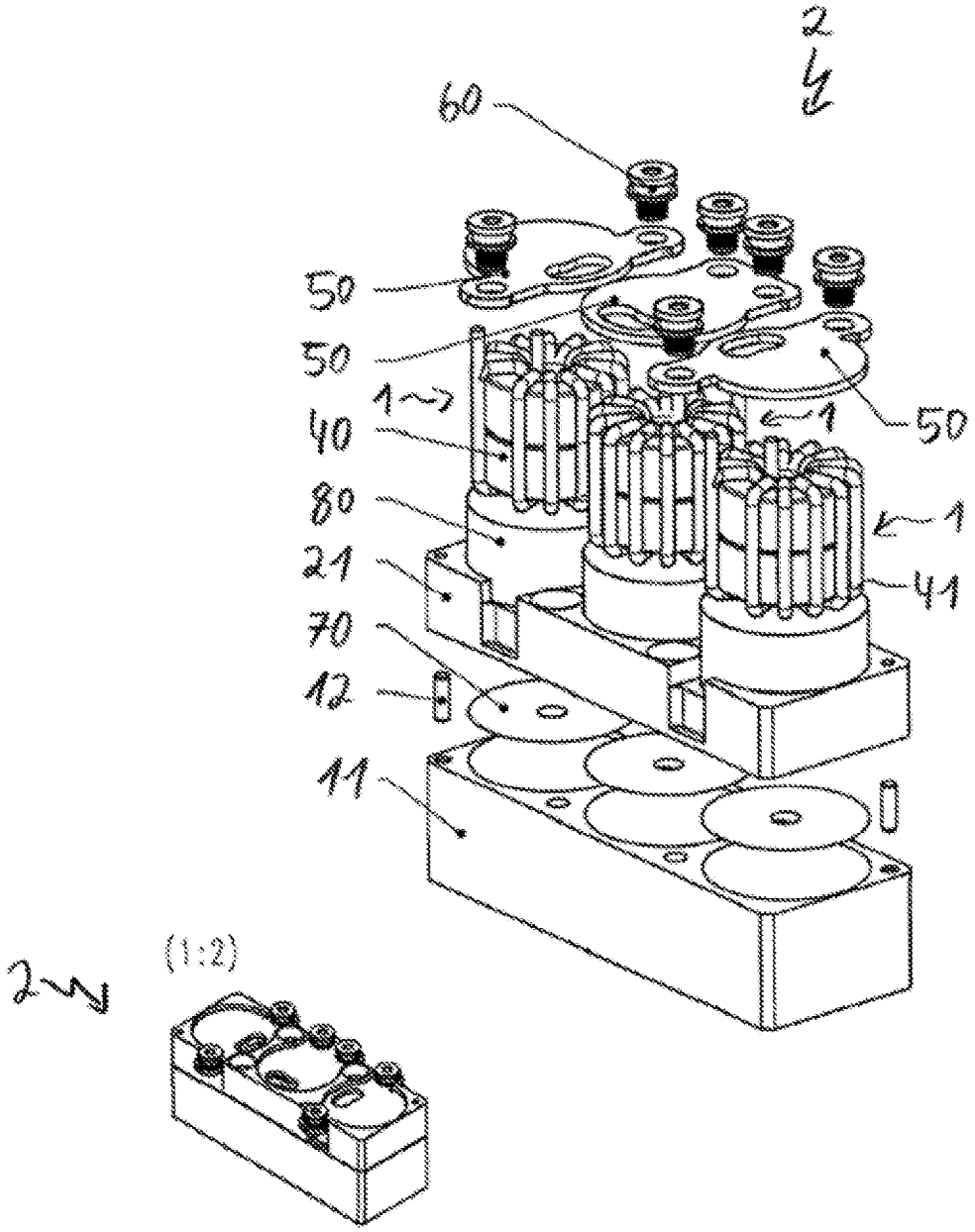
FIG. 3 shows an exploded illustration of a coil component combination according to the invention.

FIG. 3 shows an exploded illustration of a coil component combination 2.

The coil component combination 2 has three coil components 1, as already illustrated in principle in FIG. 1.

The coil component combination 2 has a single cup main body formed from a single cup main body base plate 11 and an individual cup main body sleeve 21, wherein the cups of the respective coil components 1 are formed by the cup main body 11, 21. To this end, the cup main body base plate 11 and the cup main body sleeve 21 have appropriate circularly cylindrical cavities, which are used to receive the respective components 40, 41, 70, 80.

Connecting pins 12 are used to pin the cup main body base plate 11 to the cup main body sleeve 21.

The coil component combination 2 reduces the manufacturing and material costs if a plurality of coil components is needed.

What is claimed is:

1. A coil component, comprising:
- a cup;
- a soft magnetic core;
- an electric conductor wound around the core;
- a cover, which closes the cup; and
- electric terminal contacts, which are in electric contact with ends of the electric conductor, wherein
- the core and the electric conductor are arranged in the cup,
- the cup is filled with a potting compound,
- the coil component has an electrically insulating film, and
- the coil component has a pin, wherein the pin is arranged in an opening in the core, and
- the core, the electric conductor and the pin are arranged in the cup, wherein the electrically insulating film is wound around the pin,
- the coil component further comprising:
  - further electric conductors, which are wound around the core; and
  - further electric terminal contacts, which are in electric contact with associated ends of the further electric conductors.

2. The coil component as claimed in claim 1, wherein the core is an annular core.

3. The coil component as claimed in claim 1, wherein the cup interior is at least partly covered by an electrically insulating film.

4. The coil component as claimed in claim 1, wherein the potting compound contains polyurethane, thermally conductive filler and a hardener and/or contains aluminum oxide powder.

5. The coil component as claimed in claim 1, wherein the cup is made of plastic or of aluminum.

6. The coil component as claimed in claim 1, wherein the cup is circularly cylindrical.

7. The coil component as claimed in claim 1, wherein the cup has a base plate and a sleeve.

8. The coil component as claimed in claim 1, wherein the pin has a fixing device, which is designed to fix the coil component mechanically to a circuit board and/or to a heat sink.

9. The coil component as claimed in claim 1, wherein the cover is formed as a circuit board, wherein conductor tracks which connect the electric terminal contacts electrically to the ends of the electric conductor are formed on the circuit board.

10. A coil component combination, comprising:
- (i) a plurality of coil components, each coil component comprising:
  - a cup;
  - a soft magnetic core;
  - a plurality of electric conductors wound around the core;
  - a cover, which closes the cup; and
  - a plurality of electric terminal contacts, each pair of electric terminal contacts being in electric contact with ends of a respective one of the plurality of electric conductors, wherein
  - the core and the plurality of electric conductors are arranged in the cup,
  - the cup is filled with a potting compound,
  - the coil component has an electrically insulating film, and
  - the coil component has a pin, wherein the pin is arranged in an opening in the core, and
  - the core, the plurality of electric conductors and the pin are arranged in the cup, wherein the electrically insulating film is wound around the pin; and
- (ii) a single cup main body, wherein each cup of the plurality of coil components is formed in the cup main body or is formed by way of the cup main body.

11. The coil component combination as claimed in claim 10, wherein the cup main body is formed as a heat sink.

* * * * *